US005957345A

United States Patent [19]

Petrou et al.

[11] Patent Number: 5,957,345

[45] Date of Patent: Sep. 28, 1999

[54] GARMENT HANGER CLAMP PADS WITH SIDE CLIPS

[76] Inventors: Nicoleon Petrou, 1531 W. Tadmar Ave., Anaheim, Calif. 92802; David Petrou, 2826 Hillegass Ave., Berkeley, Calif. 94705

[21] Appl. No.: 08/653,849

[22] Filed: May 28, 1996

[51] Int. Cl.[6] ..... A47G 25/48

[52] U.S. Cl. ..... 223/96; 223/91; 24/477

[58] Field of Search ..... 223/85, 90, 91, 223/93, 96, 95; 24/477

[56] References Cited

U.S. PATENT DOCUMENTS

| | | | |
|---|---|---|---|
| 2,419,723 | 4/1947 | Mack, Sr. | 223/96 |
| 2,517,336 | 8/1950 | Neal | 223/94 |
| 2,517,804 | 8/1950 | Shane | 23/96 |
| 3,767,092 | 10/1973 | Garrison et al. . | |
| 4,157,782 | 6/1979 | Mainetti | 223/96 |
| 4,718,581 | 1/1988 | Chiarmonte | 223/96 |
| 5,083,691 | 1/1992 | Handrick | 223/96 |
| 5,178,306 | 1/1993 | Petrou | 223/96 |
| 5,297,706 | 3/1994 | Blitz . | |

*Primary Examiner*—Bibhu Mohanty
*Attorney, Agent, or Firm*—Frank G. Morkunas

[57] ABSTRACT

A garment hanger with clamp pads proximate the opposite ends thereof. The garment hanger includes an elongated garment hanger body and the clamp pads are formed integrally with the garment hanger body to present opposing faces on opposite sides. A U-shaped clip is adapted to slide laterally along each clamp pad to provide a means for releasably locking a garment on the clamp pad. Angled or inclined rails on each pad provide a progressive tightening mechanism for selectively holding a garment against each clamp pad.

21 Claims, 4 Drawing Sheets

10
20
12
12a
12b
14
28
28a
28b
30
40
42
44
50
52
54
90
100
A
2
2

GARMENT HANGER CLAMP PADS WITH SIDE CLIPS

BACKGROUND OF THE INVENTION

The present invention relates generally to garment hangers having clamp pads at the opposite ends thereof, and, in particular, to clamp pads for garment hangers using side clips to hold garments directly to the garment hanger body without the need for opposing clam-shell type clamp pads.

Garment hangers having clamp pads at the opposite ends thereof are well known and are provided in various forms. Such garment hangers generally include an elongated garment hanger body having a hook extending upwardly from a central location thereof, and clamps at the opposite ends thereof. Early garment hangers of this type essentially included clothespin-type spring-loaded clamps at the ends of the garment hanger body.

With the ongoing developments in plastic molding technologies, plastic-molded garment hangers were generally provided with clamps at the opposite ends thereof. Each clamp included a first pad formed integrally with the garment hanger body and positioned in the plane thereof, and a second clamp pad joined by a living hinge to the first clamp pad to permit the first and second clamp pads acting like a clam-shell to capture a garment therebetween when the first and second clamp pads were held closed.

In order to hold the clamp pads closed, early garment hangers used a separate metal spring clip. U.S. Pat. No. 3,767,092 is exemplary of such garment hangers with clamp pads using sliding metal spring clips to hold the clamp pads in closed condition. Of course, the hangers are molded separately from the metal clips and then the metal clips must be inserted, at least a two step operation. To use such hangers, first the garment is positioned between the clamp pads, the second clamp pad is pivoted towards the first clamp pad and the metal clip is snapped into position.

Recently, U.S. Pat. No. 5,297,706 issued and discloses an all plastic garment hanger having clamping pads at the end thereof with the first clamp pad formed with the garment hanger body and the second clamp pad integrally formed therewith through a living hinge to permit opening and closing of the clamps. The benefit of this patent resides in the use of all plastic locking clips which are integrally formed and joined to the garment hanger body through the use of living hinges such that no separate metal spring clips or other such components are required. A multi-step operation is still required to hold garments on the hanger.

While such clamping garment hangers have been accepted as generally satisfactory, it is desirable to provide a garment hanger with clamp pads wherein garments are clamped directly to the pad with a clip, without the need for a pivotable second clamp pad, as well as other features. The present invention provides such a development.

SUMMARY OF THE INVENTION

Generally speaking, in accordance with the present invention, a garment hanger having an elongated garment hanger body is provided. A clamp pad is formed integrally with the garment hanger body at each end thereof and presents opposing faces on opposite sides of the garment hanger body. A U-shaped clip is adapted to slide laterally along each clamp pad to provide a means for releasably locking a garment on the clamp pad.

In a preferred embodiment, the U-shaped clips are joined to the garment hanger body through the use of a flexible plastic strap which permit the sliding movement to occur. Slanted projections on each pad provide a progressive tightening mechanism for selectively holding a garment against each clamp pad. A tongue and groove arrangement on the clip and pad permits the clip to be releasably positioned in discrete locations along the clamp to provide discrete locking positions.

Accordingly, it is an object of the present invention to provide an improved garment hanger with clamp pads at the opposite ends thereof.

Another object of the present invention is to provide an improved clamp pad with a clip construction preferably for use on garment hangers.

A further object of the present invention is to provide a garment hanger with clamps at the opposite ends thereof, wherein each clamp requires only one clamp pad and a sliding clip to releasably hold garments on the garment hanger.

A still further object of the present invention is to provide a garment hanger with clamps at the opposite ends thereof with clips joined to the garment hanger body by flexible straps.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
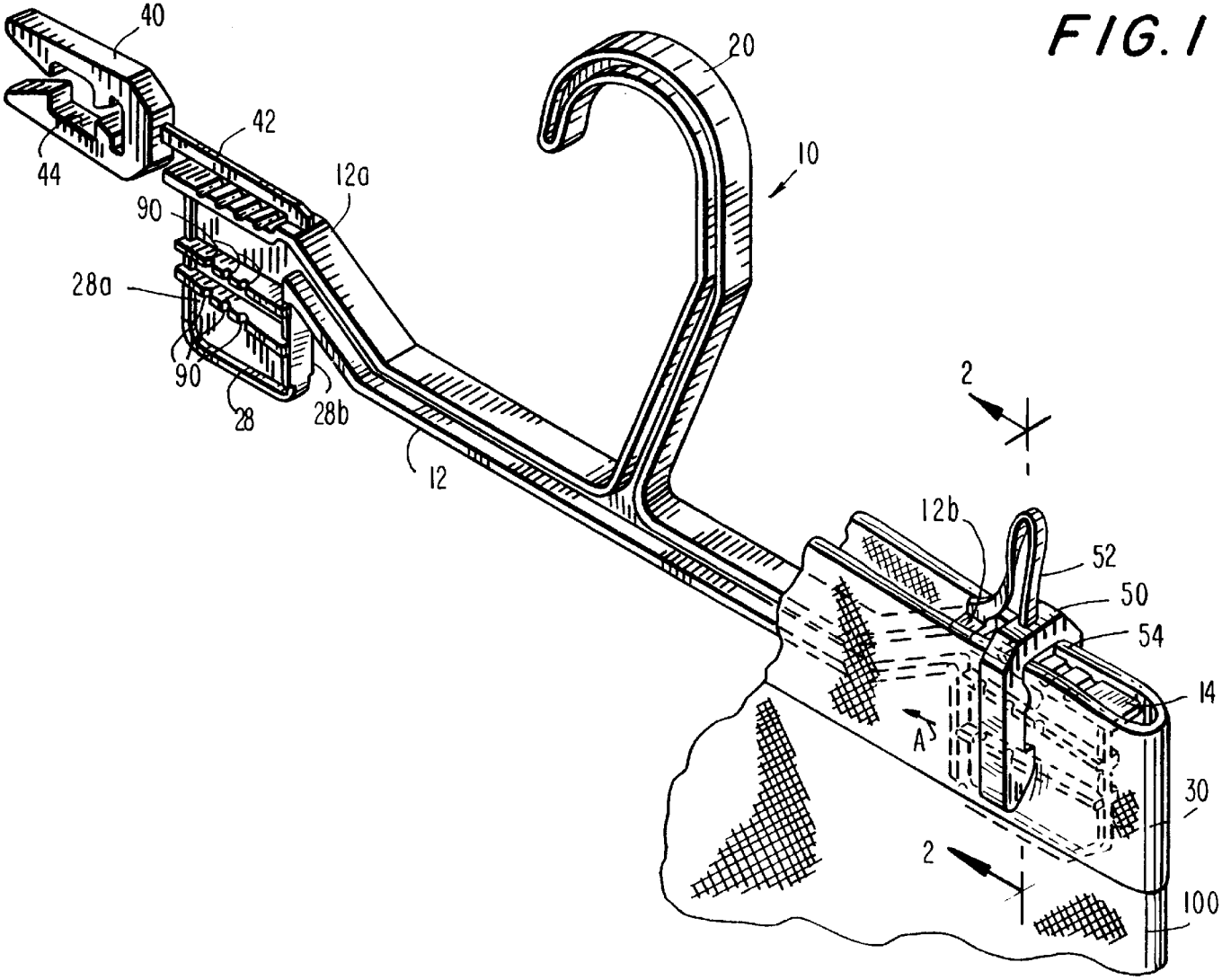
FIG. 1 is a perspective view of a garment hanger constructed in accordance with a preferred embodiment of the present invention, with one clamp member and clip shown positioned in its molding orientation and the other clamp pad and clip showing a garment secured by such clamp.

Reference is first made to FIG. 1 which depicts a garment hanger, generally indicated at 10, constructed in accordance with a preferred embodiment of the present invention. Hanger 10 includes an elongated garment hanger body 12 having a hook 20 extending upwardly from a central portion of a garment hanger body 12. Hook 20 allows garment hanger 10 to be suspended from a rod or other support. Garment hanger 10 is preferably integrally molded from a thermoplastic material such as polypropylene, although it is recognized that other plastic materials may be utilized, and is formed in an I-beam construction.

Garment hanger body 12 of garment hanger 10 includes opposite ends 12*a* and 12*b* each of which have secured thereto and integrally formed therewith a clamp pad 28 and 30, respectively. Since clamp pads 28 and 30 are similarly constructed, only the details of construction one of the two clamp pads will be provided and referenced. It is also noted that the clamp pad construction can be used apart from a garment hanger or can be used as a single clamp pad with a hook extending directly therefrom. It is further noted that instead of providing separately defined clamp pads at opposite ends of the garment hanger body, the clamp pads may be defined or formed as part of the garment hanger body itself.

Figure 3:
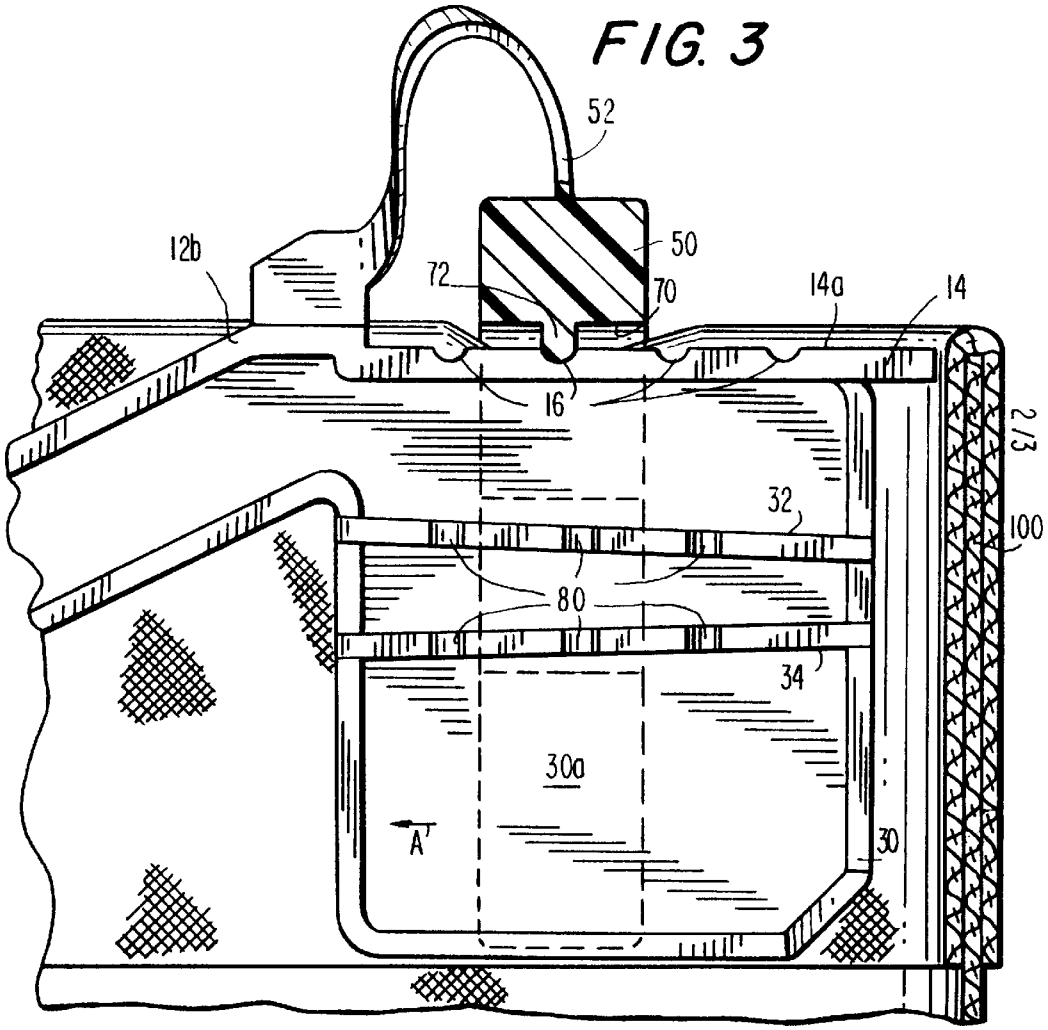
FIG. 3 is a sectional view taken along line 3—3 of FIG. 2.

Clamp pad 30 (as does clamp pad 28), includes opposite sides 30*a* and 30*b* (shown as 28*a* and 28*b* on clamp 28). As depicted, clamp 30 is generally rectangular in shape (although other shapes may be used) and includes spaced elongated projections or rails 32 and 34 on face 30*a* and spaced elongated projections or rails 36 and 38 on face 30*b* of clamp pad 30. Rails 32 and 34 are slanted or angled with respect to one another as best depicted in FIG. 3. Similarly, rails 36 and 38 on the opposite side face 30*b* are similarly slanted or angled with respect to one another. In FIG. 1, the rails illustrated on face 28*a* of clamp pad 28 are also outwardly inclined; i.e., being wider at the inner end where clamp pad 28 is connected to hanger body 12 than at the outer end.

Clamp pad 28 has an associated clip 40 while clamp pad 30 has an associated clip 50. Clip 40 is coupled to the top of garment hanger body 12 proximate pad 28 by a strap 42 while clip 50 is coupled to the top of garment hanger body 12 proximate pad 30 by a strap 52. Clips 40 and 50 are similarly constructed and only one will be described in detail.

Figure 2:
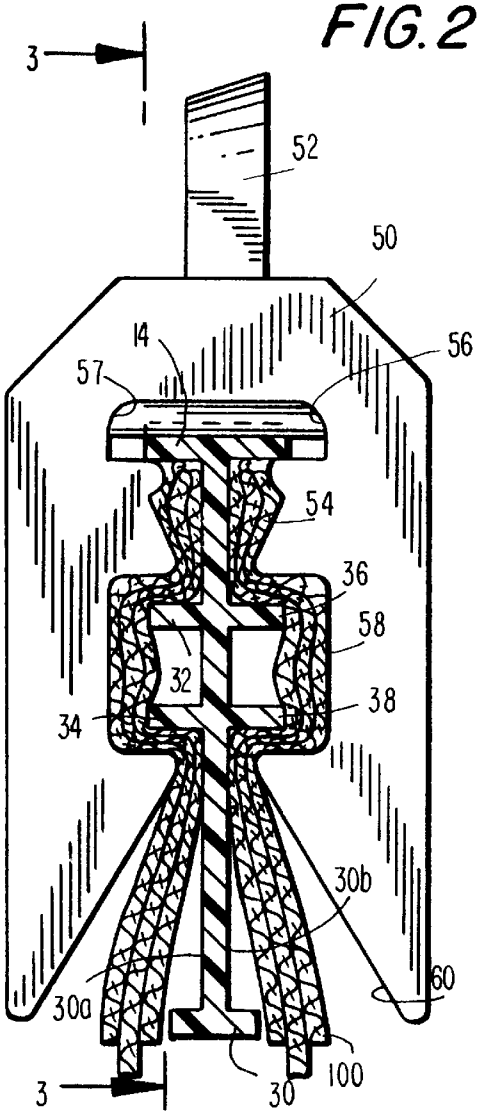
FIG. 2 is an enlarged sectional view taken along line 2—2 of FIG. 1.

Each clip 40 and 50 includes an hour glass-type cutout pattern 44 and 54, respectively, although other patterns may be used. Upper portion 56 of cutout region 54 includes a narrow slot 57 adapted to receive and ride along upper I-beam panel 14 of garment hanger body 12. Middle portion 58 of cutout region 54 is essentially rectangular in side view and is adapted to ride over and along opposing slanted rails 32 and 34 and 36 and 38, as best depicted in FIG. 2. Lower portion 60 of cutout region 54 is an inverted V-shaped configuration.

In use, a garment 100 to be hung on garment hanger 10 of the present invention such as a pair of pants, or the like, is placed such that clamp pads 28 and 30 extend intermediate the waistband thereof, for example. Respective clips 40 and 50 are slid from the outer side of the clamp pads along the garment in the direction of arrow A to provide appropriate clamping pressure. Because rails 32, 34, 36 and 38 are slanted or angled, as depicted, the sliding of clip 50 in the direction of arrow A will cause increased tightening of the clamp and clip construction against the garment.

In this regard, each of rails 32, 34, 36 and 38 can include nubs or indentations 80 (shown as 90 on clamp pad 28) to provide additional frictional holding power. In addition, the inner surface 70 of clip 50 (and likewise clip 40) may include a projection 72, and the top surface 14*a* of top I-beam 14 may include series of corresponding indentations 16 to provide a tongue and groove releasable locking arrangement to act as a ratchet mechanism for selectively locking the respective clips in desired positions. It is noted that other types of locking mechanisms could be utilized or the tongues and grooves could be reversed.

Straps 42 and 52 are flexible and permit appropriate movement and positioning of the clips to which they are attached. The straps act to hold the clips to the garment hanger body so that they are always available when needed, and allow for integral molding of the complete garment hanger assembly.

Figure 4:
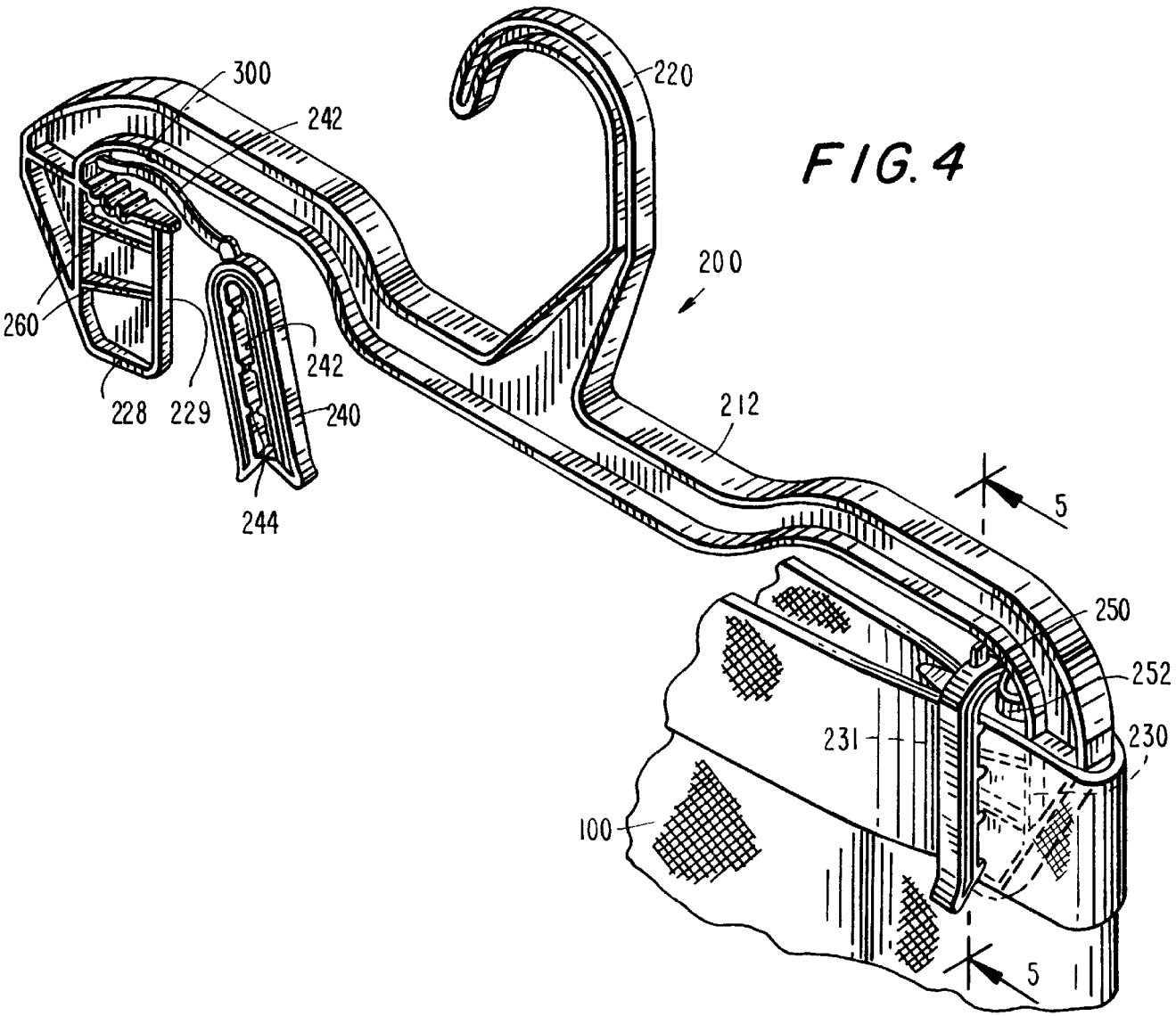
FIG. 4 is a perspective view similar to FIG. 1, but depicting an alternative embodiment of the present invention.
Figure 6:
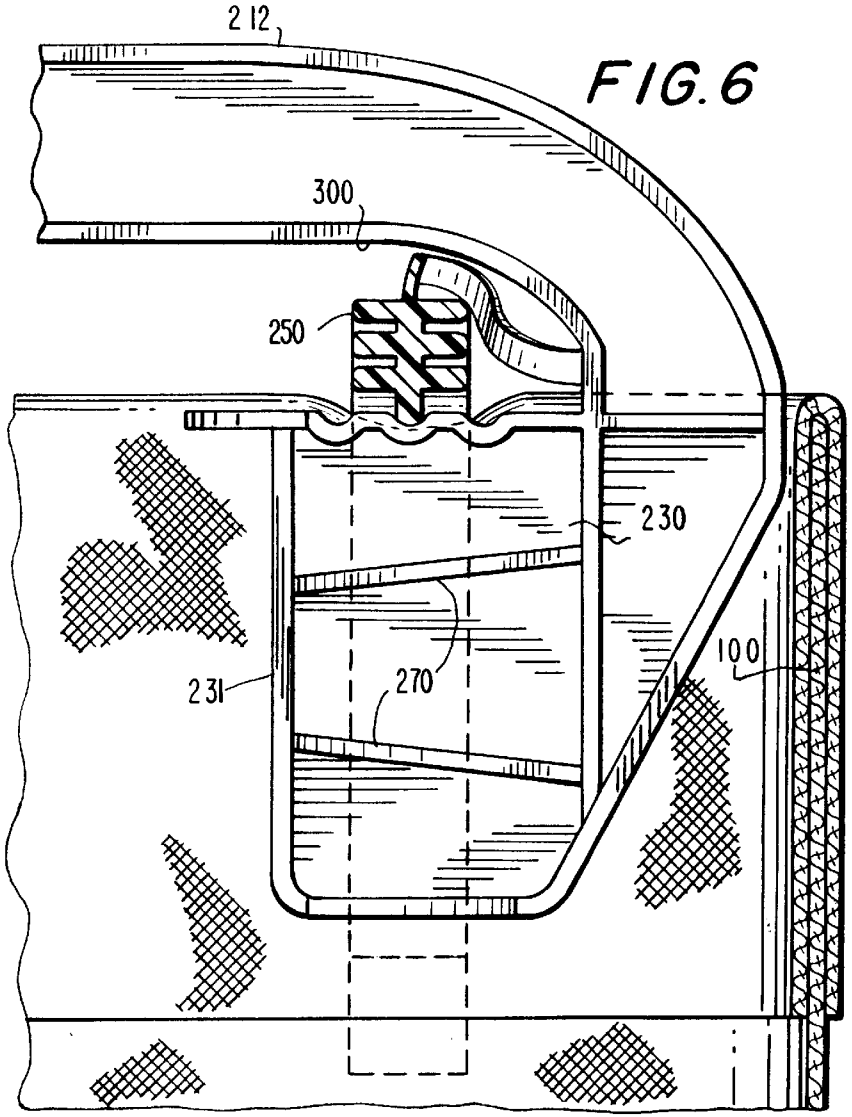
FIG. 6 is a secitonal view taken along line 6—6 of FIG. 5.
Figure 5:
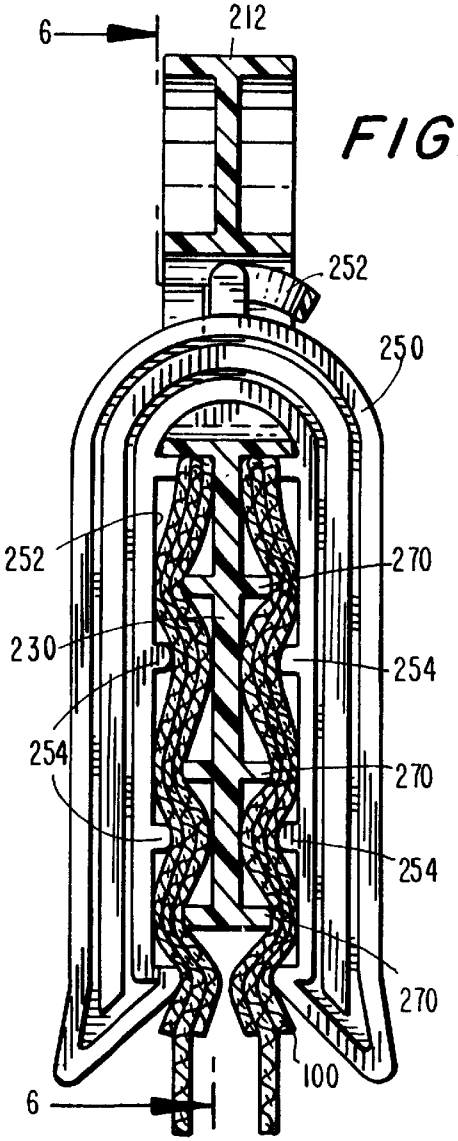
FIG. 5 is an enlarged sectional view taken along line 5—5 of FIG. 4.

Referring now to FIGS. 4 through 6 of the drawings, an alternative embodiment of the present invention embodied in a garment hanger, generally indicated at 200, is depicted. Garment hanger 200 includes an elongated garment hanger body 212 having a hook 220 extending upwardly therefrom. Garment hanger 200 is constructed similarly to garment hanger 10 depicted in FIGS. 1 through 3, but the arrangement of clamp pads 228 and 230 are somewhat different. While in the embodiment of FIGS. 1 through 3 the clamp pads are positioned at the free opposite ends of the garment hanger body, in the embodiment depicted in FIGS. 4 through 6, the clamp pads extend inwardly under garment hanger body 212 such that free ends 229 and 231 of the respective clamp pads face one another. In addition, clips 240 and 250 are joined to garment hanger body 212 by a flexible strap 242 and 252, respectively. Flexible straps are joined to the underside of garment hanger body 212.

Clips 240 and 250 are U-shaped as depicted. Inner surfaces 242 and 252, respectively, of the clips, include projections 244 and 254, respectively, which cooperate with projections or rails 260 and 270, respectively, on respective pads 228 and 230 to provide the requisite gripping power for a garment 100 captured therebetween as best depicted FIG. 5. It is noted that rails 260 and 270 may be both slanted with respect to one another and inclined with respect to the clamp pad, as depicted in FIG. 4, to provide additional gripping power. In this embodiment, the rails 260 are wider at the outer end than at the free end 229. Also, an indexing system or ratchet system as found in the first embodiment of FIGS. 1 through 3 is shown being used in the second embodiment of FIGS. 4 through 6 to releasably lock the respective clips against the clamp pads. In this regard, a gap 300 is provided between the top of the clamp pads and the lower surface of the garment hanger body to provide clearance for the top of the clips.

The present invention provides a garment hanger with opposing clamps at the opposite ends thereof which requires only one clamp pad and associated clip at each end. Alternatively, the clamp pads may be formed as part of the garment hanger body itself. The degree of holding power is selectable and the clips can be releasably locked in desired positions. All integral plastic molding does away with the need for separate metal spring clips or the like.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A garment hanger comprising a garment hanger body having opposite ends, a non-movable clamp pad positioned proximate each said opposite end, each clamp pad having an outwardly exposed face and a lateral projection on said face, and a U-shaped clip slidable laterally along the lateral projection on the face of each said clamp pad for releasably securing a garment against said clamp pad.

2. The garment hanger as claimed in claim 1, wherein said projection includes rails which extend in the direction of said garment hanger body, said rails being angled with respect to one another on each said face.

3. The garment hanger as claimed in claim 2, wherein said U-shaped clip includes a slot therein adapted to receive and ride along said rails to releasably secure a garment against said clamp pad.

4. The garment hanger as claimed in claim 1, wherein said U-shaped clip includes a flexible twistable strap which integrally joins said U-shaped clip to said garment hanger body proximate its respective claim pad.

5. The garment hanger as claimed in claim 4, wherein said strap permits said clip to be slid laterally along said respective clamp pad.

6. The garment hanger as claimed in claim 1, wherein said clip and clamp pad include corresponding ratchet means for selectively positioning said clip in desired positions along said clamp pad.

7. The garment hanger as claimed in claim 6, wherein said ratchet means includes a tongue and groove construction.

8. The garment hanger as claimed in claim 1, wherein said clamp pads are formed integrally with said garment hanger body.

9. The garment hanger as claimed in claim 8, wherein said clamp pads are formed as part of said garment hanger body.

10. The garment hanger as claimed in claim 8, wherein said garment hanger body and clamp pads are integrally molded from a thermoplastic material.

11. The garment hanger as claimed in claim 4, wherein said garment hanger body, clamp pads, U-shaped clips and flexible straps are integrally molded from a thermoplastic material.

12. The garment hanger as claimed in claim 1, wherein said garment hanger body includes a hook.

13. The garment hanger as claimed in claim 1, wherein each said clamp pad includes opposing rails on said opposing faces thereof.

14. A clamp comprising a non-movable clamp pad having first and second opposing outward facing sides, at least one of said sides including a lateral projection, and a U-shaped clip having a slot therein to receive said projection for sliding thereover, said U-shaped clip further having a flexible strap which joins said U-shaped clip to said clamp pad, whereby a garment placed against said clamp can be secured to said clamp by sliding said clip over said outward facing sides of said garment and translating said slot along said projection on said clamp pad.

15. The clamp as claimed in claim 14, wherein said projection includes a first elongated rail extending along said clamp pad.

16. The clamp as claimed in claim 15, wherein said projection includes a second elongated rail angled with respect to said first elongated rail, wherein said rails are outwardly angled.

17. The clamp as claimed in claim 13, wherein said clamp pad, U-shaped clip and flexible strap are integrally formed from a thermoplastic material.

18. A garment hanger comprising an elongated garment hanger body having opposite ends, a non-movable clamp pad positioned proximate each said opposite end below said garment hanger body, each clamp pad having a free end which faces the free end of the other clamp pad, each clamp pad have an outwardly exposed face and a lateral projection on said face, and a U-shaped clip slidable laterally along the lateral projection on the face of each said clamp pad for releasably securing a garment against said clamp pad.

19. The garment hanger as claimed in claim 18, wherein said projection includes rails which extend in the direction of said garment hanger body, said rails being inclined with respect to said garment hanger body.

20. The garment hanger as claimed in claim 19, wherein said U-shaped clip includes a slot therein adapted to receive and ride along said rails to releasably secure a garment against said clamp pad.

21. The garment hanger as claimed in claim 20, wherein said U-shaped clip includes a flexible strap which integrally joins said U-shaped clip to said garment hanger body proximate its respective clamp pad.

* * * * *